United States Patent [19]

Gilvar

[11] 4,182,148

[45] Jan. 8, 1980

[54] MULTI-LINE ROLLING SYSTEM

[75] Inventor: Martin Gilvar, Oakham, Mass.

[73] Assignee: Morgan Construction Company, Worcester, Mass.

[21] Appl. No.: 892,932

[22] Filed: Apr. 3, 1978

Related U.S. Application Data

[63] Continuation-in-part of Ser. No. 812,453, Jul. 5, 1977, abandoned.

[51] Int. Cl.[2] ..... B21B 1/00; B21B 35/00

[52] U.S. Cl. ..... 72/228; 72/238; 72/249

[58] Field of Search ..... 72/226, 228, 250, 231, 72/234, 235, 249, 238, 239

[56] References Cited

U.S. PATENT DOCUMENTS 3,491,570 1/1970 Beard ..... 72/239

3,942,350 3/1976 Brauer et al. ..... 72/228

FOREIGN PATENT DOCUMENTS 42058 2/1956 Fed. Rep. of Germany ..... 72/249

*Primary Examiner*—Milton S. Mehr

*Attorney, Agent, or Firm*—Thompson, Birch, Gauthier & Samuels

[57] ABSTRACT

A multi-line rolling system having a plurality of rolling positions aligned in the direction of rolling. Each rolling position includes a housing or housing structures supporting at least two sets of work rolls which may be selectively coupled to a common power source, thereby permitting the rolling line formed by one roll set to be rendered inoperative while the rolling line of the other roll set continues to roll product received from a feed line. The system further includes an appropriate switching mechanism for directing product from the feed line to either rolling line.

12 Claims, 8 Drawing Figures

MULTI-LINE ROLLING SYSTEM

CROSS-REFERENCE TO RELATED APPLICATION

This is a continuation-in-part of U.S. Ser. No. 812,453 filed July 5, 1977, abandoned.

BACKGROUND OF THE INVENTION

This invention relates generally to bar and rod rolling mills, and is concerned in particular with the provision of a multi-line rolling system which is ideally suited for, although not limited to, the rolling of substantially continuous prduct lengths, for example continuously cast billets or series of discrete billets joined end to end as by welding.

Maximizing rolling mill efficiency by minimizing unproductive "down" time is a matter of vital concern to all mill operators. This concept becomes even more important when rolling a substantially continuous billet, for in this situation an interruption in the rolling schedule usually necessitates an immediate disruption of the upstream billet processing equipment, and an attendant scrapping of the billet length already on its way to the rolling line.

Rolling interruptions are commonly occasioned by the need to replace worn equipment such as work rolls, guides, etc. The use of multiple alternately usuable rolling lines has already been proposed, where it would be possible for worn equipment on one rolling line to be replaced while rolling continued on another rolling line. In this connection, see for example U.S. Pat. Nos. 1,514,179; 1,935,048; 3,382,697; 3,383,896 and 3,930,395. However, in these known arrangements the rolling lines are driven by their own separate power sources, reduction gearing, etc. Such arrangements are thus very costly because of the substantial capital investment required for duplicated drive equipment, and the building space needed to house the mill equipment.

Other arrangements have been proposed where multiple rolling lines are driven by a common power source. In this connection, see for example U.S. Pat. No. 3,391,562. Arrangements of this type are also unsatisfactory because the rolling lines are not independently operable. Thus, if one rolling line is taken out of service, the other rolling lines must also be stopped.

The present invention has as its general objective the provision of a novel and improved multi-line rolling system which not only obviates the above-mentioned problems, but in addition provides other significant advantages of considerable importance to the mill operator.

The rolling system of the present invention basically comprises a plurality of rolling positions aligned in the direction of rolling. Each rolling position has at least two sets or pairs of work rolls, one pair forming a first rolling line and the other pair forming a second rolling line. The work rolls and their respective bearing chocks may be supported either in one or several housing structures. A power source is associated with each rolling position. The power source is connected to the roll pairs of each rolling line by an intermediate drive means which includes a clutch means. The clutch means operates to selectively interrupt the drive connection between the power source and the roll pairs of either rolling line. This permits one rolling line to be stopped for maintenance purposes while the other rolling line continues to roll product received from an upstream feed line. A switching mechanism alternately directs product from the feed line to either of the rolling lines. As soon as the required maintenance has been completed on a given rolling line, it can be clutched into operation and thereafter run "empty" in readiness for immediate use as soon as the other rolling line is rendered inoperative.

The rolling lines may be closely spaced by employing a single housing structure for all of the roll pairs at a given rolling position. This offers certain advantages, including a conservation of valuable building space and the possibility of servicing both rolling lines with rapidly traversable crop shears and dividing shears.

Alternatively, the roll pairs may be supported in separate widely spaced housing structures, with the power sources and the intermediate drive means located between the rolling lines.

In all cases, however, the rolling lines are separated by appropriate safety enclosures which allow operating personnel to service a deactivated rolling line while the other rolling line is in operation.

DESCRIPTION OF PREFERRED EMBODIMENTS

Figure 1:
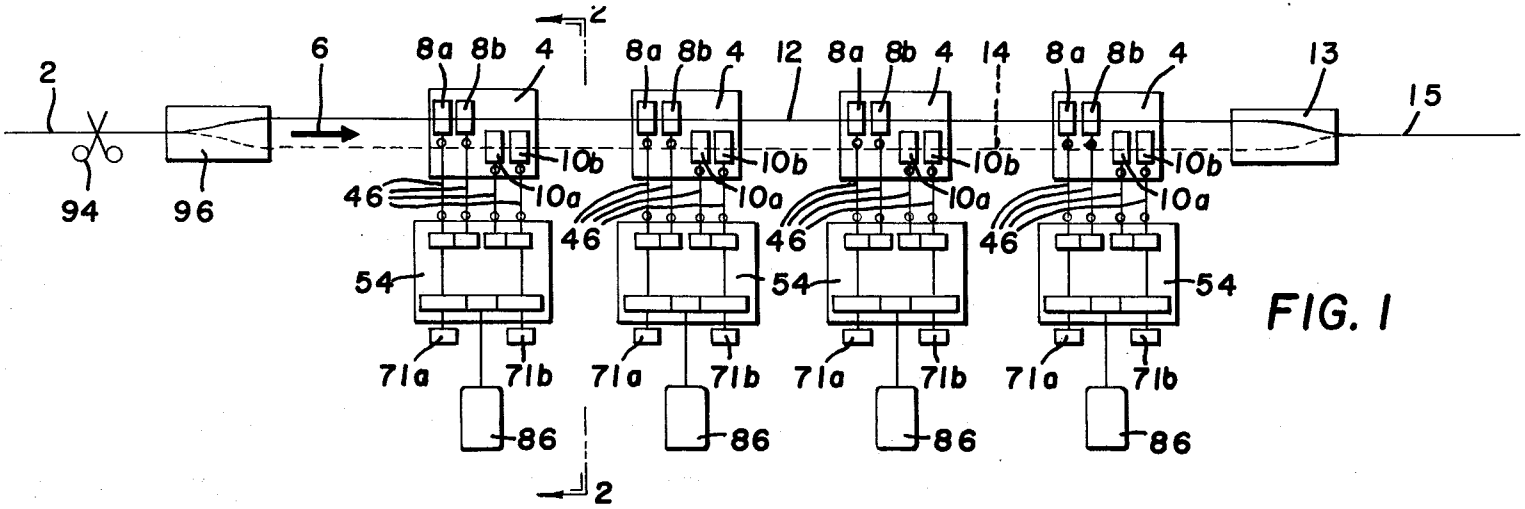
FIG. 1 is a diagrammatic illustration of one embodiment of a multi-line rolling system embodying the concepts of the present invention, with housing structures, protective enclosures, etc. omitted in order to better illustrate the drive arrangement at each rolling position. In this connection, it should be understood that although the horizontal roll pairs at each rolling position are in vertical alignment as shown in FIG. 2, they have been diagrammatically illustrated in this figure in a vertically staggered relationship in order to show all rolls of both rolling lines.
Figure 2:
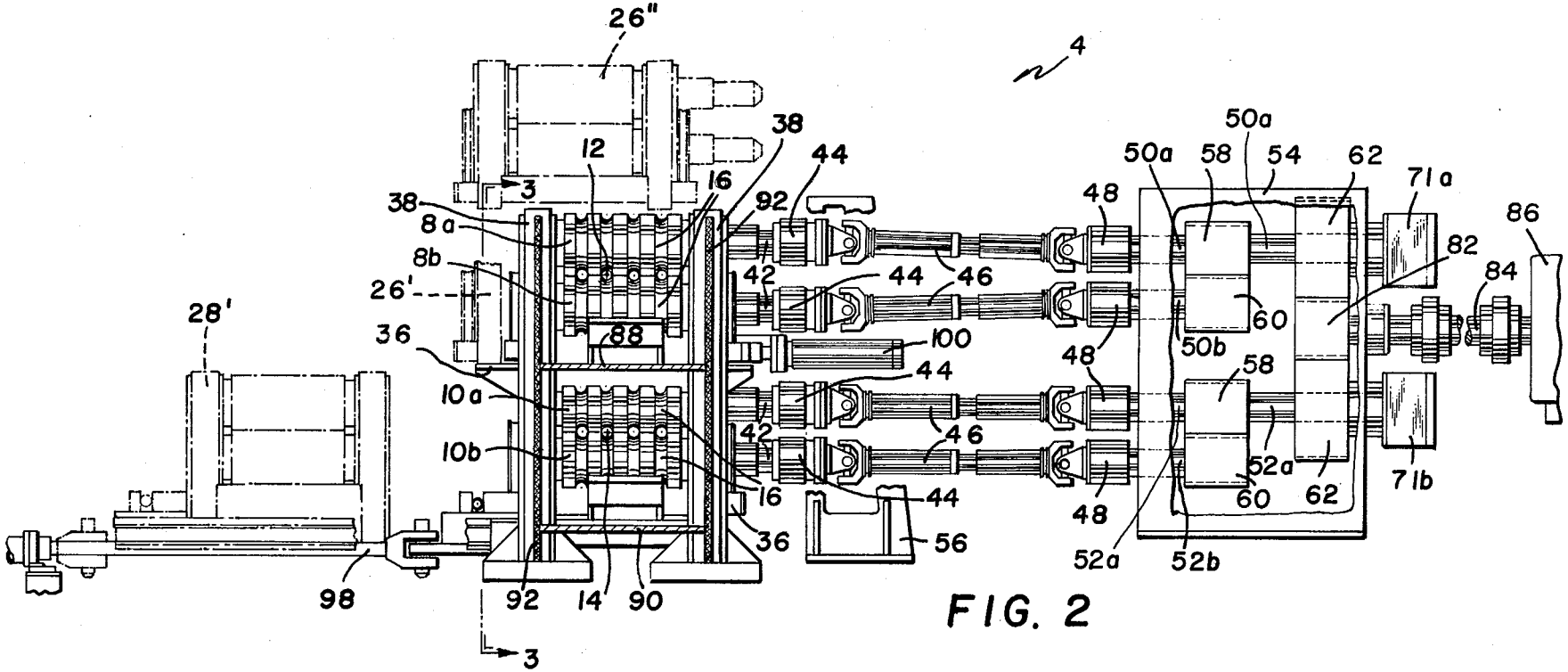
FIG. 2 is a view of a rolling position on a greatly enlarged scale taken along line 2—2 of FIG. 1.
Figure 3:
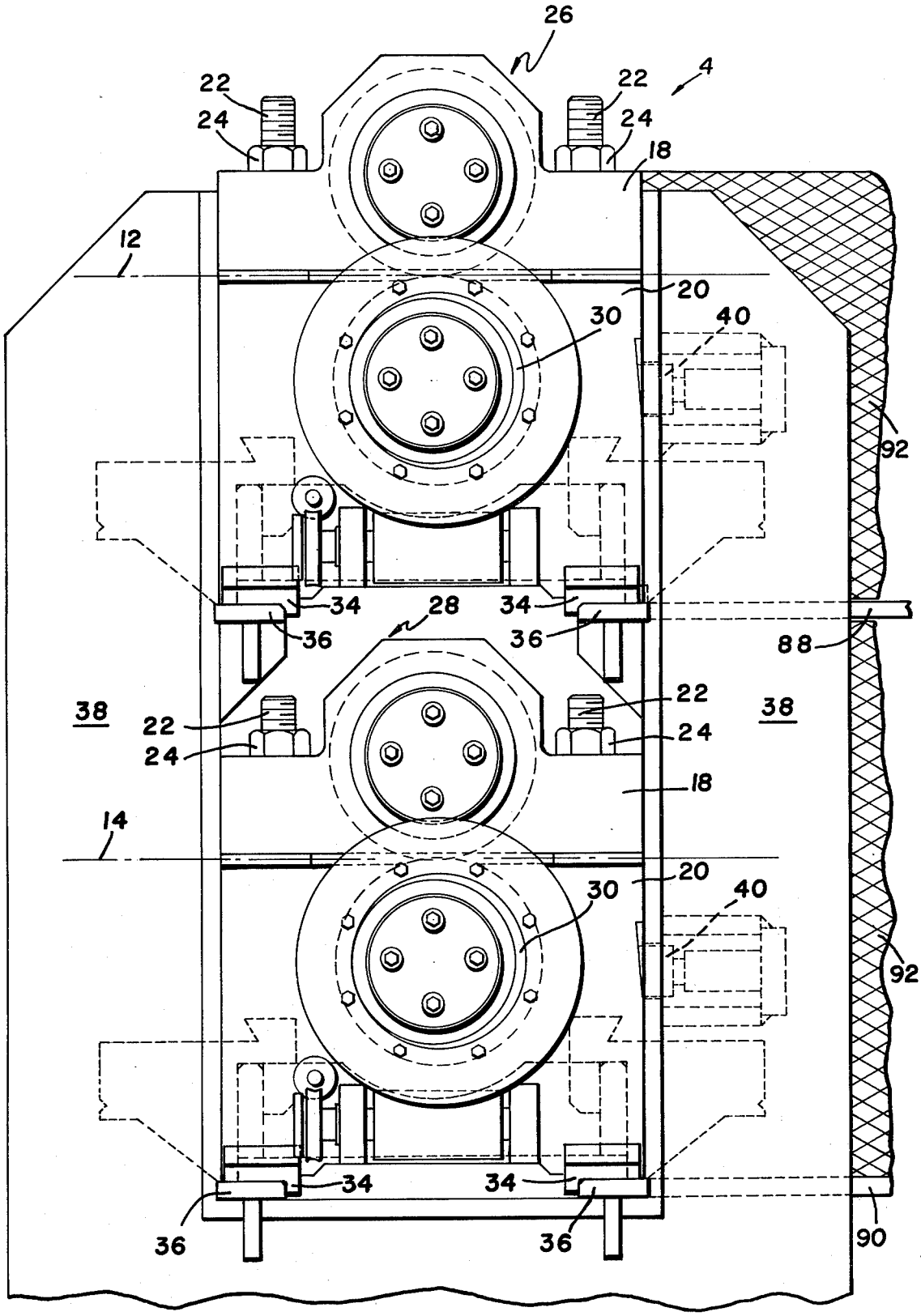
FIG. 3 is an enlarged end view of the housing structure shown in FIG. 2.

Referring initially to FIGS. 1–3, one embodiment of a multi-line rolling system is shown for rolling product received from a feed line 2. The system includes a plurality of rolling positions 4 aligned in the direction of rolling (which is schematically depicted in FIG. 1 by arrow 6). Each rolling position includes first and second pairs of work rolls 8*a*, 8*b* and 10*a*, 10*b*. The first roll pairs 8*a*, 8*b* are arranged to form a first rolling line 12, and the second roll pairs 10*a*, 10*b* are likewise arranged to form a second rolling line 14.

The work rolls have multiple grooves indicated typically at 16 in FIG. 2. The upper work rolls 8*a*, 10*a* of each roll pair are straddle mounted between upper bearing chocks 18, and the lower work rolls 8*b*, 10*b* are likewise straddle mounted between lower bearing chocks 20. The upper and lower bearing chocks 18, 20 of each roll pair preferably are interconnected by rugged threaded studs 22 and nuts 24. When thus connected, the chocks combine with the work rolls to provide first and second roll packages generally indicated at 26, 28.

The lower bearing chocks 20 may contain eccentric sleeves 30 which are rotatable in a known manner to provide a means of adjusting the parting between the work rolls.

The lower bearing chocks 20 may also have shoes 34 seated on stationary tracks 36 extending horizontally between support posts 38 of a supporting housing structure. Hydraulically actuated clamps 40 are employed to fix the shoes 34 of the lower bearing chocks 20 in place on the tracks 36.

As is best shown in FIG. 2, the work rolls have extensions 42 on the "drive" side of the mill which are detachably connected in a known manner by means of universal couplings 44 to telescopic spindles 46. The opposite ends of the spindles 46 are connected by other universal couplings 48 to two pairs of intermediate drive shafts 50*a*, 50*b* and 52*a*, 52*b* which are journalled for rotation about fixed axes in a pinion housing 54. A conventional spindle carrier 56 is located between the roll housing structure and the pinion housing 54.

Figure 6:
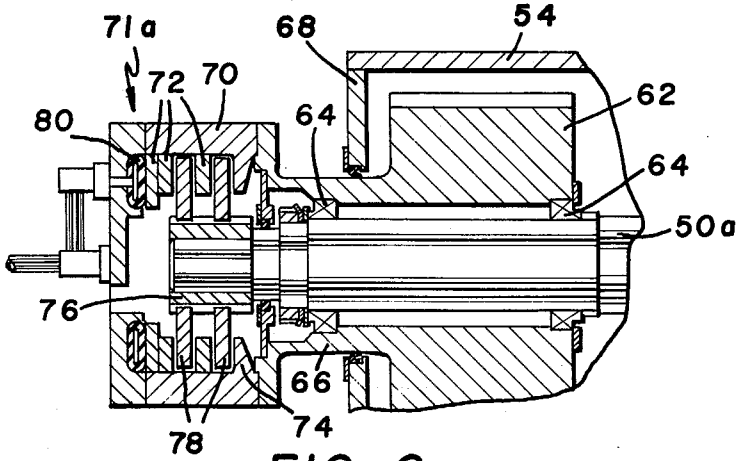
FIG. 6 is an enlarged sectional view depicting an alternate clutching arrangement.

The upper intermediate drive shafts 50*a*, 52*a* each carry gears 58 which mesh with gears 60 on the lower intermediate drive shafts 50*b*, 52*b*. An additional gear 62 is carried on each of the upper intermediate drive shafts 50*a*, 52*a*. As is best shown in FIG. 6, the gear 62 is rotatably mounted on its intermediate drive shaft 50*a* by means of bearings 64. The gear 62 has a cylindrical extension 66 which protrudes through the rear wall 68 of the pinion housing 54. The extension 66 supports the housing 70 of an upper clutch 71*a*. The housing 70 carries a plurality of axially shiftable annular clutch plates 72 and a fixed stop ring 74. The end of drive shaft 50*a* has a sleeve 76 keyed thereto, which carries axially shiftable clutch plates 78. The clutch 71*a* is engaged by inflating an annular tube 80, the expansion of which shifts the clutch plates 72, 78 to the right as viewed in FIG. 6 and towards the stop ring 74. By bringing the clutch plates into mutual frictional engagement, a drive relationship is established between gear 62 and intermediate drive shaft 50*a*. It will be understood that when the tube 80 is deflated, appropriately positioned springs (not shown) return the plates 72, 78 to the condition shown in FIG. 6, thereby disengaging the clutch. The lower intermediate drive shaft 52*a* is connected to its respective gear 62 in an identical manner by a lower clutch 71*b*. The gears 62 are each in meshed relationship with a drive gear 82 on the input shaft 84 leading from a power source 86.

The rolling lines 12, 14 are separated one from the other and contained within protective cages which include vertically spaced floor plates 88, 90 and heavy duty wire mesh side walls 92. The cages extend between the rolling positions 4 and are constructed with suitable access doors (not shown) so that operating personnel can safely work on a deactivated rolling line while the other rolling line continues to roll product. Product rolled by either rolling line 12 or 14 is redirected by means of a guide mechanism 13 into a common delivery line 15.

Assume for example that the work rolls or guides of rolling line 14 are worn and in need of replacement, and that the mill is rolling a substantially continuous billet length being received along feed line 2 from an upstream casting machine (not shown). A shear 94 will first be employed to sever the billet length. The billet length located downstream from the cut is allowed to run through rolling line 14, while the new leading end is directed by a switch 96 into rolling line 12. It will be understood that rolling line 12 has already been clutched in and run up to speed. Rolling thereafter continues along line 12 without necessitating any interruption whatsoever of the upstream billet processing equipment. After product has left rolling line 14, the clutches 71*b* are disengaged. This renders the rolling line 14 totally inoperative while product continues through line 12.

Equipment along rolling line 14 can then be adjusted, repaired or replaced. When rolls are worn, the lower clamps 40 are disengaged to free the lower roll packages 28. Thereafter, each roll package 28 is moved horizontally out of roll housing structure by means of a piston-operated shifting mechanism 98 to a position indicated by dot-dash lines at 28'. As a roll package 28 moves to the left as viewed in FIG. 2, the spindle couplings 44 disengage themselves from the work roll extensions 42, and the spindles are temporarily supported on the spindle carrier 56. The roll package can then be removed by an overhead crane and replaced by a fresh package which can be reinserted into the housing by reversing the above procedure.

After the worn roll packages 28 have been reinserted and clamped in their operative positions in the roll housing structure, the rolling line 14 is clutched into operation and brought back up to speed. The rolling line 14 thereafter remains in full readiness to accept product at any given time.

When the necessity arises to render the rolling line 12 inoperative, the shear 94 is again actuated and the new leading end is directed by switch 96 to the rolling line 14. The clutches 71*a* are then disengaged. If worn rolls are to be replaced, the upper clamps 40 are disengaged to free the upper roll packages 26. Each roll package 26 is then shifted horizontally to the left as viewed in FIG. 2 by means of a piston-operated mechanism 100 into an intermediate position indicated in dot-dash lines at 26'. The purpose of this movement is merely to disengage the spindle couplings 44 from the roll shaft extensions 42. Thereafter, the upper roll packages 26 are lifted away from the roll housings as shown schematically by the dot-dash lines at 26''. After the upper roll packages 26 have been replaced, the upper clutches 71*a* are reengaged and the rolling line 12 is brought back up to speed in readiness for continued operation when required.

Figure 4:
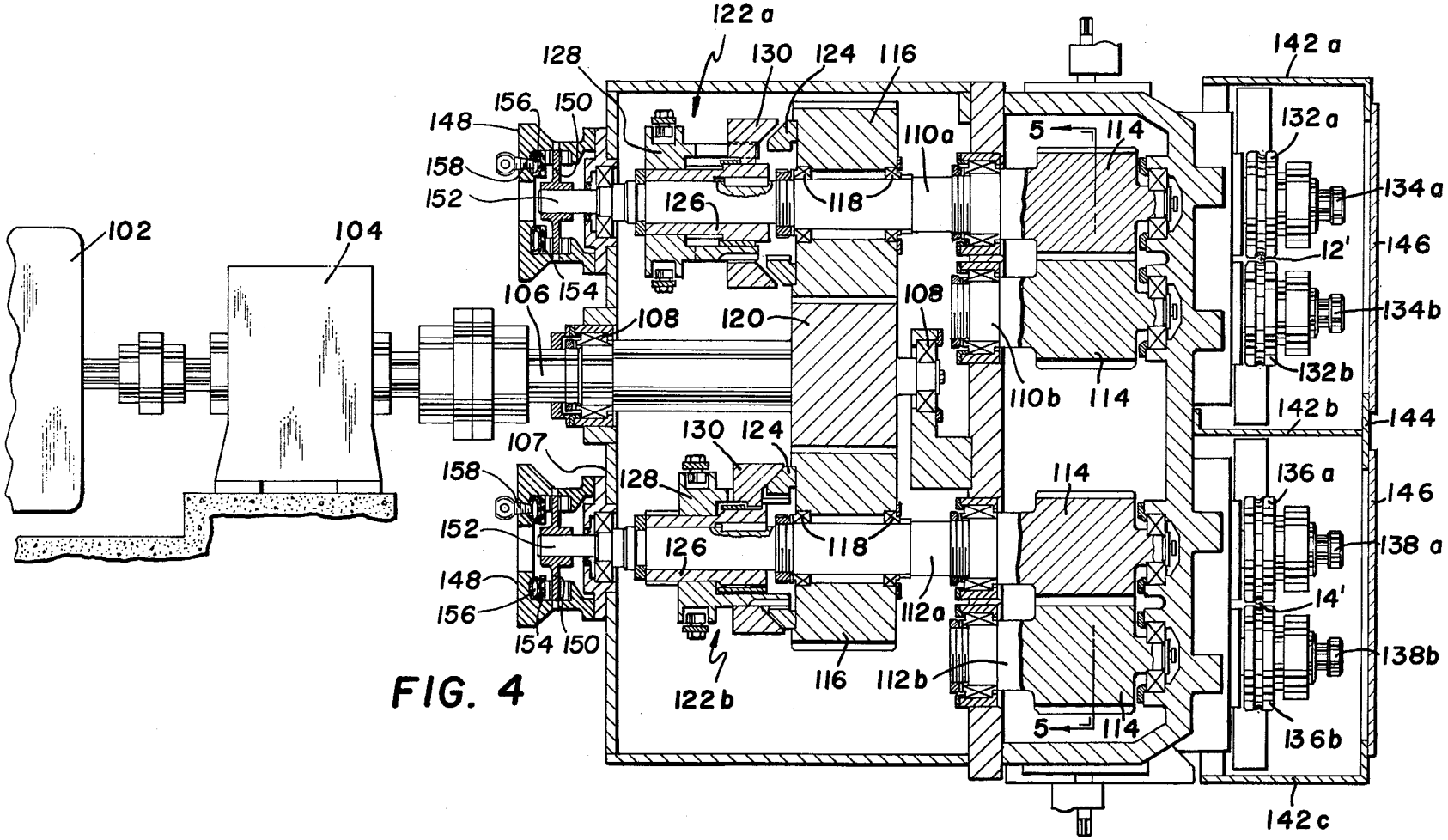
FIG. 4 is a vertical sectional view taken through the housing structure of an alternate embodiment of the invention employing cantilevered roll discs rather than straddle mounted rolls.
Figure 5:
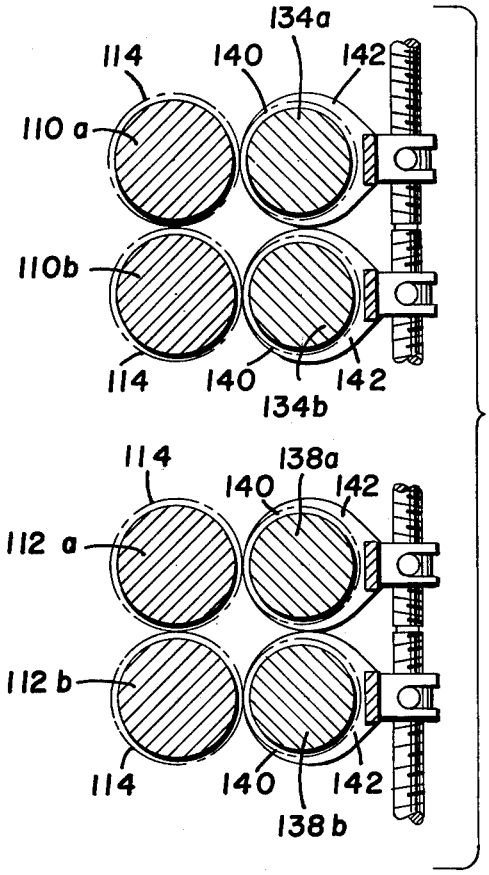
FIG. 5 is a sectional view taken along line 5—5 of FIG. 4.

Another embodiment of the invention employing cantilevered roll discs rather than straddle mounted work rolls is shown in FIGS. 4 and 5. In this arrangement, a power source which may conveniently comprise an electric drive motor 102, operates through appropriate reduction gearing in a gear box 104 to drive an input shaft 106.

The input shaft 106 protrudes into a gear box 107 where it is suitably journalled between bearings 108. The gear box contains upper and lower pairs of intermediate drive shafts 110*a*, 110*b* and 112*a*, 112*b*, each pair being interconnected by intermeshed gears 114. The intermediate drive shafts 110*a* and 112*a* each carry additional gears 116 which are rotatably mounted thereon by means of bearings 118. Each gear 116 is in meshed relationship with a drive gear 120 on shaft 106. Clutches 122a, 122b are operatively arranged between the gears 116 and their respective intermediate drive shafts 110a, 112a. Each clutch includes a somewhat conical clutch plate 124 fixed to the gear 116 for rotation therewith, and a sleeve 126 keyed to a cylindrical extension of the shaft. Each sleeve carries an axially shiftable element 128 with a conical contact member 130 at its innermost end. The upper clutch 122a is shown in its disengaged position with the contact member 130 spaced axially from the conical clutch plate 124. The lowermost clutch 122b is shown at its engaged position with the elements 124, 130 in mutual frictional engagement.

The upper rolling line 12' is formed between a pair of upper roll discs 132a, 132b detachably mounted in cantilever fashion on the ends of a pair of upper roll shafts 134a, 134b, contained in a roll housing detachably mounted on the gear box 107. Likewise, the lower rolling line 14' is formed between lower roll discs 136a, 136b mounted in cantilever fashion on the ends of a pair of lower roll shafts 138a, 138b also contained in a detachable roll housing. As is best shown in FIG. 5, the roll shafts each carry gears 140 which are not meshed with each other but which are individually meshed with adjacent gears 114 on the intermediate drive shafts. The roll shafts are journalled in rotatable sleeves having integral eccentric portions 142. Roll parting adjustments are made by rotating the sleeves in their respective roll housings.

The rolling lines 12', 14' are appropriately enclosed within protective housings including: top, intermediate and bottom walls 142a, 142b and 142c; a front wall 144 and access doors 146.

If desired, in order to expedite gaining access to a rolling line after it has been deactivated, brakes 148 may be employed to decelerate and stop the intermediate drive shafts 110a, 112a. Each brake includes a disc 150 fixed to a shaft extension 152. The disc 150 is frictionally acted upon by a pad 154 which is operated by an inflatable tubular ring 156 receiving compressed air through an inlet 158.

Figure 7:
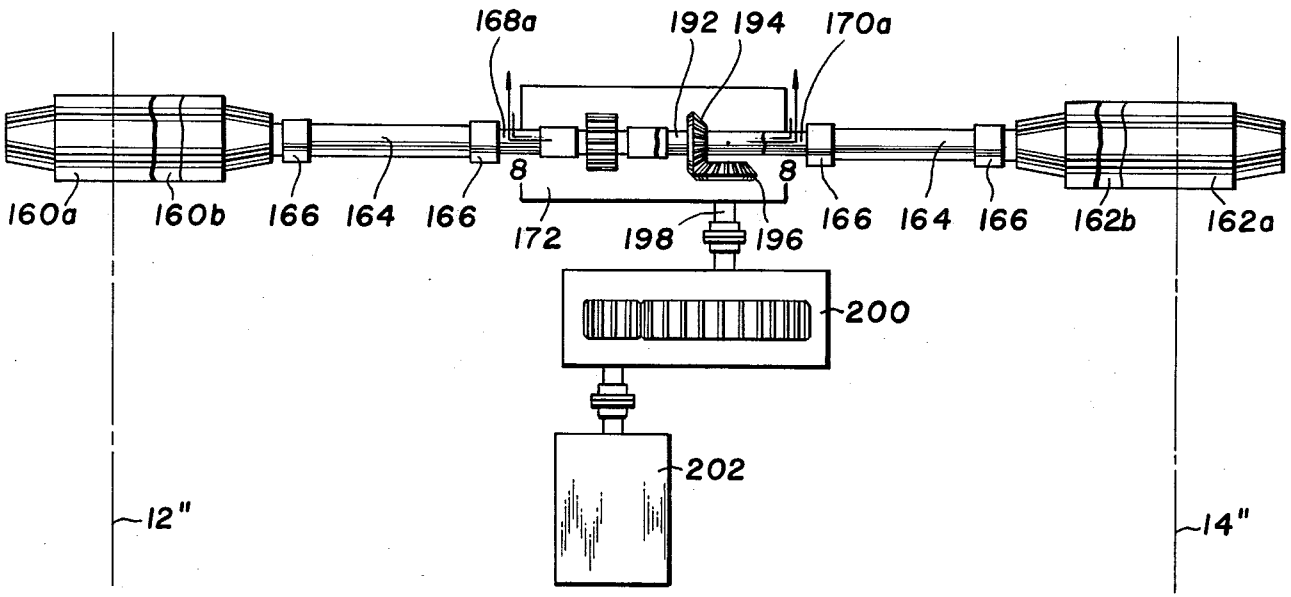
FIG. 7 is a schematic plan view of a rolling position in still another embodiment of the invention; and, FIG. 8 is a sectional view taken along lines 8—8 of FIG. 7.
Figure 8:
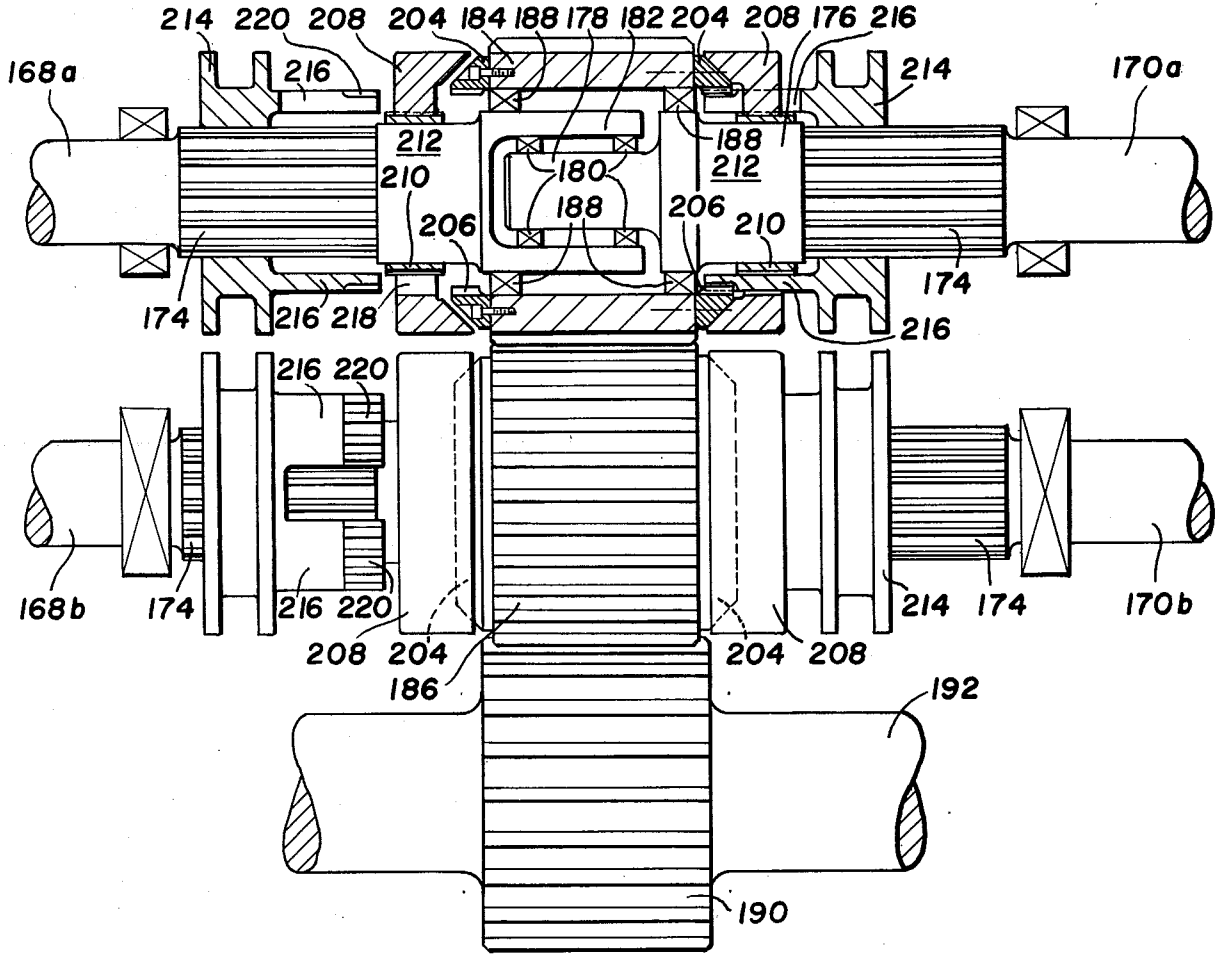

Another embodiment of the invention is shown in FIGS. 7 and 8. Here, the rolling lines 12", 14" are horizontally arranged and more widely spaced than in the other described embodiments. Rolling line 12" is defined by pairs of horizontal work rolls 160a, 160b, and rolling line 14" is likewise defined by pairs of horizontal work rolls 162a, 162b. The work rolls of each pair are connected by conventional spindles 164 and universal couplings 166 to upper and lower intermediate drive shaft pairs 168a, 168b and 170a, 170b which extend laterally in opposite directions from a gear box 172 located between the rolling lines.

As is best shown in FIG. 8, each of the intermediate drive shafts has a splined section 174. Upper intermediate drive shaft 170a has a male head 176 with a reduced diameter end 178 journalled by means of bearings 180 in a female head 182 on intermediate drive shaft 168a. Although not shown, it will be understood that the intermediate drive shafts 168b and 170b are arranged in an identical manner. The upper and lower male and female heads 176, 182 are respectively surrounded by hollow pinions 184, 186 journalled for rotation independently of the intermediate drive shafts by bearings 188. The pinions 184, 186 are intermeshed, and the lower pinion 186 meshes with a third pinion 190 on a shaft 192 carrying bevel gear 194. Bevel gear 194 meshes with bevel gear 196 on the output shaft 198 of a gear box 200 driven by a motor 202.

Conventional automotive-type synchronizers may be employed to selectively connect and disconnect the intermediate drive shaft pairs 168a, 168b and 170a, 170b to the pinions 184, 186. Such synchronizers, which are well known to those skilled in the art, will be briefly described as follows: each of the pinions 184, 186 carries oppositely facing male cone rings 204 which have internal teeth 206. The male cone rings are arranged to be engaged by female cone rings 208 carried on cylindrical cocking springs 210 which are in turn axially slidable on cylindrical sections 212 of the male and female heads 176, 182. Sliding dog clutches 214 are carried on the splined sections 174. The dog clutches have fingers 216 which are axially movable through openings 218 in the female cone rings 208. The fingers 216 have toothed ends 220. During engagement, the sliding dog clutches are moved by means (not shown) from the disengaged position shown at the left hand side of FIG. 8 towards the pinions 184, 186. As the fingers 216 move through the openings 218, the cocking springs 210 are engaged and carried along, causing the female cone rings 208 to frictionally engage the male cone rings 204. Further axial movement of the sliding dog clutches 214 brings the toothed ends 220 of fingers 216 into engagement with the teeth 206 on the male cone rings 204, as shown on the right-hand side of FIG. 8. Disengagement occurs by moving the sliding dog clutches in the opposite direction away from the pinions 184, 186.

Although not illustrated, it is to be understood that suitable protective enclosures will surround each of the rolling lines 12", 14" so as to make it possible to work on a deactivated rolling line while the other continues to roll product.

In light of the foregoing, it will now be appreciated by those skilled in the art that the present invention provides a multi-line rolling system consisting of a series of rolling positions, each having at least two sets of work rolls which can be selectively coupled to a primary power source. The work rolls can either be of the straddle mounted type as shown in FIGS. 2 and 7, or of the cantilever type as shown in FIG. 4. The system includes independent protective enclosures for each rolling line. Thus, work rolls and guides can be safely changed or otherwise maintained on a deactivated rolling line while metal is being processed on an adjacent line, without incurring the cost and space disadvantages of using two completely independent mill drive systems. The system of the present invention is particularly advantageous when rolling from a substantially continuous feed source, for the following reasons: feeding the system can continue when active rolls and/or guides are worn by shearing the product in advance of the system and simultaneously switching the new front end to an alternate path. Thereafter, by opening appropriate safety enclosures, worn rolls and/or guides can be changed while rolling continues. Also, an alternate rolling line which has had its rolls and guides renewed can be clutched into the drive system and run in an empty condition. In the event of a cobble in the active rolling line, the feed source can be sheared and switched to the alternate path, thus avoiding a total stoppage of the mill. Another peripheral advantage is that by having alternate rolling lines relatively close to one another, is shown in particular in FIGS. 2 and 7, crop shears, dividing shears and other like equipment within the multi-line portion of the system can be rapidly traversed between both rolling lines, thus avoiding the need for duplication of such equipment.

It is my intention to cover all changes and modifications to the embodiments herein chosen for purposes of disclosure which do not depart from the spirit and scope of the invention.

I claim:

1. A multi-line rolling system for rolling product received from a feed line, comprising: a plurality of rolling positions aligned in the direction of rolling; roll housing means for supporting first and second pairs of work rolls at each rolling position, the first roll pairs being arranged to form a first rolling line and the second roll pairs being arranged to form a second rolling line; a single power source associated with each rolling position, intermediate drive means for connecting said power source to the first and second roll pairs at each rolling position, said intermediate drive means having clutch means associated therewith for selectively interrupting the drive connection between said power source and the roll pairs forming either rolling line, whereby one of said rolling lines may be rendered inoperative while the other rolling line continues to roll product received from said feed line; and, switching means for alternately directing product from said feed line to either of said rolling lines.

2. The rolling system of claim 1 wherein said first and second roll pairs and their respective bearing chocks are separately interconnected to form first and second roll packages, the said roll packages being mounted in a common roll housing means and being separately detachable therefrom.

3. The rolling system of claim 2 wherein said first and second roll packages are aligned vertically.

4. The rolling system of claim 3 further comprising means for displacing said roll packages in a direction parallel to the roll axes during removal and replacement of said roll packages.

5. The rolling system of claim 4 wherein the lowermost bearing chocks of each roll package are slidable in said direction along tracks carried on vertically extending support posts.

6. The rolling system of claim 1 further comprising shear means in advance of said switching means for subdividing the product received from said feed line.

7. The rolling system of claim 1 further comprising guide means for redirecting product from either of said rolling lines into a delivery line.

8. The rolling system of claim 1 wherein the first and second rolling lines are separated by and contained within protective enclosures, the said enclosures being separately accessible for maintenance purposes.

9. The rolling system of claim 1 wherein said intermediate drive means include an input shaft carrying a drive gear, a pair of intermediate drive shafts for each of said first and second roll pairs, each pair of intermediate drive shafts carrying intermeshed gears, with one intermediate drive shaft of each pair carrying an additional gear in meshed relationship with said drive gear.

10. The rolling system of claim 9 wherein said clutch means is operatively connected between each of said one intermediate drive shafts and the additional gear carried thereon.

11. The rolling system of claim 1 further comprising brake means for decelerating each roll pair after the drive connection thereto has been interrupted by said clutch means.

12. The rolling system of claim 1 wherein said power source and said intermediate drive means are positioned between said rolling lines.

* * * * *